US012735898B2

(12) United States Patent
Toca et al.

(10) Patent No.: US 12,735,898 B2
(45) Date of Patent: Sep. 15, 2026

(54) LIPPAGE CONTROL SYSTEM WITH STRETCHABLE STRAP PORTION

(71) Applicant: DTM INNOVATIONS LLC, Metairie, LA (US)

(72) Inventors: Roland Toca, New Orleans, LA (US); Michele Volponi, Metairie, LA (US); Darrin Godbold, Metairie, LA (US)

(73) Assignee: DTM INNOVATIONS LLC, Metairie, LA (US)

( * ) Notice: Subject to any disclaimer, the term of this patent is extended or adjusted under 35 U.S.C. 154(b) by 199 days.

(21) Appl. No.: 18/732,224

(22) Filed: Jun. 3, 2024

(65) Prior Publication Data

US 2024/0318436 A1 Sep. 26, 2024

Related U.S. Application Data

(60) Continuation-in-part of application No. 16/807,280, filed on Mar. 3, 2020, now Pat. No. 12,000,156, which is a division of application No. 15/711,159, filed on Sep. 21, 2017, now Pat. No. 10,604,945.

(60) Provisional application No. 62/397,724, filed on Sep. 21, 2016.

(51) Int. Cl.

| | |
|---|---|
| ***E04F 15/02*** | (2006.01) |
| ***E04F 13/08*** | (2006.01) |
| ***E04F 21/00*** | (2006.01) |
| ***E04F 21/18*** | (2006.01) |

(52) U.S. Cl.
CPC .... *E04F 15/02022* (2013.01); *E04F 21/0092* (2013.01); *E04F 21/1844* (2013.01); *E04F 13/0892* (2013.01)

(58) Field of Classification Search
CPC ..... E04F 15/02022; E04F 21/0092; E04F 21/1844; E04F 13/0892
See application file for complete search history.

(56) References Cited

U.S. PATENT DOCUMENTS

| | | | | |
|---|---|---|---|---|
| 9,447,590 | B2 * | 9/2016 | Sighinolfi | E04F 21/18 |
| 10,883,285 | B1 * | 1/2021 | Zherlo | E04F 21/0092 |
| 2005/0150340 | A1 * | 7/2005 | Terry | B29C 49/72 83/54 |
| 2010/0287868 | A1 * | 11/2010 | Kufner | E04F 21/0092 52/391 |
| 2016/0326754 | A1 * | 11/2016 | Bucsa | E04F 21/20 |
| 2018/0355623 | A1 * | 12/2018 | Frisco | E04F 15/02022 |
| 2019/0368207 | A1 * | 12/2019 | Charitou | E04F 15/02022 |
| 2022/0251856 | A1 * | 8/2022 | Bunch | E04F 21/1877 |

* cited by examiner

*Primary Examiner* — Omar F Hijaz
(74) *Attorney, Agent, or Firm* — KEATY LAW FIRM LLC; Thomas S. Keaty

(57) ABSTRACT

A tile aligning and lippage tuning system that uses a single piece base and strap which is designed to break away from the base when sufficient pressure is applied and is also designed to stretch along a thin wall region before separation of the strap from the base occurs.

2 Claims, 5 Drawing Sheets

LIPPAGE CONTROL SYSTEM WITH STRETCHABLE STRAP PORTION

CROSS-REFERENCE TO RELATED APPLICATIONS

This application is a continuation-in-part of pending application Ser. No. 16/807,280, filed on Mar. 3, 2020, which is a division of application Ser. No. 15/711,159, filed on Sep. 21, 2017, now U.S. Pat. No. 10,604,945, which claims priority from provisional application Ser. No. 62/397,724, filed on Sep. 21, 2016 by the same inventors, the full disclosures of which are incorporated by reference herein and priority of which are hereby claimed.

BACKGROUND OF THE INVENTION

This invention relates to systems and methods for laying tile and, more specifically, for efficiently reducing tile lippage. Throughout this description, the term tile is used as an example of various matter which is arranged or disposed adjacent a substrate (which can be horizontal-floors or vertical-walls or other) in multiple pieces, the term tile should be understood to include panels, sheets, boards, paving stones, bricks, stone or porcelain slabs or the like. The present invention relates more specifically to improved methods and systems which use tab systems to align tiles.

U.S. Utility Patents: U.S. Pat. Nos. 7,861,487; 8,429,878 and 8,429,879 and U.S. Design Patent D630077 and the web site www.tuscanleveling.com describe a system for aligning tiles. While such systems have enjoyed some success in the past, they do have drawbacks. Typically, such systems require the use of a tool to tighten a strap and cap combination. The tile laying professional would typically use the tool by firmly grasping a lever, trigger or other structure on the tool and causing the gap between the cap and the base of the strap to decrease. The amount and duration of the squeezing of the tool, in some designs, may determine the amount of relative movement between the cap and the base of the strap. Knowing how hard to squeeze and when to stop could be a critical skill in certain applications. Also having the requisite hand grasping strength could be an issue for some tile laying professionals.

Consequently, there is a need for improvement in tile aligning and lippage tuning systems and methods.

SUMMARY OF THE INVENTION

More specifically, an object of the invention is to provide a cost effective tile aligning and mechanical edge setting system.

It is a feature of the present invention to be a one piece base and strap structure.

It is an advantage of the present invention to decrease the time required to perform each job.

It is another feature of the invention to include a stretchable strap, tab or shaft, while the tab remains in place attached to the base located under the tile.

It is also an advantage of the present invention to provide improved ease of use and reduce unwanted strap breakage.

The present invention includes the above-described features and achieves the aforementioned objects.

Accordingly, the present invention comprises a tile leveling and mechanical edge setting system with a one piece base and strap combination with a detachable stretchable strap.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
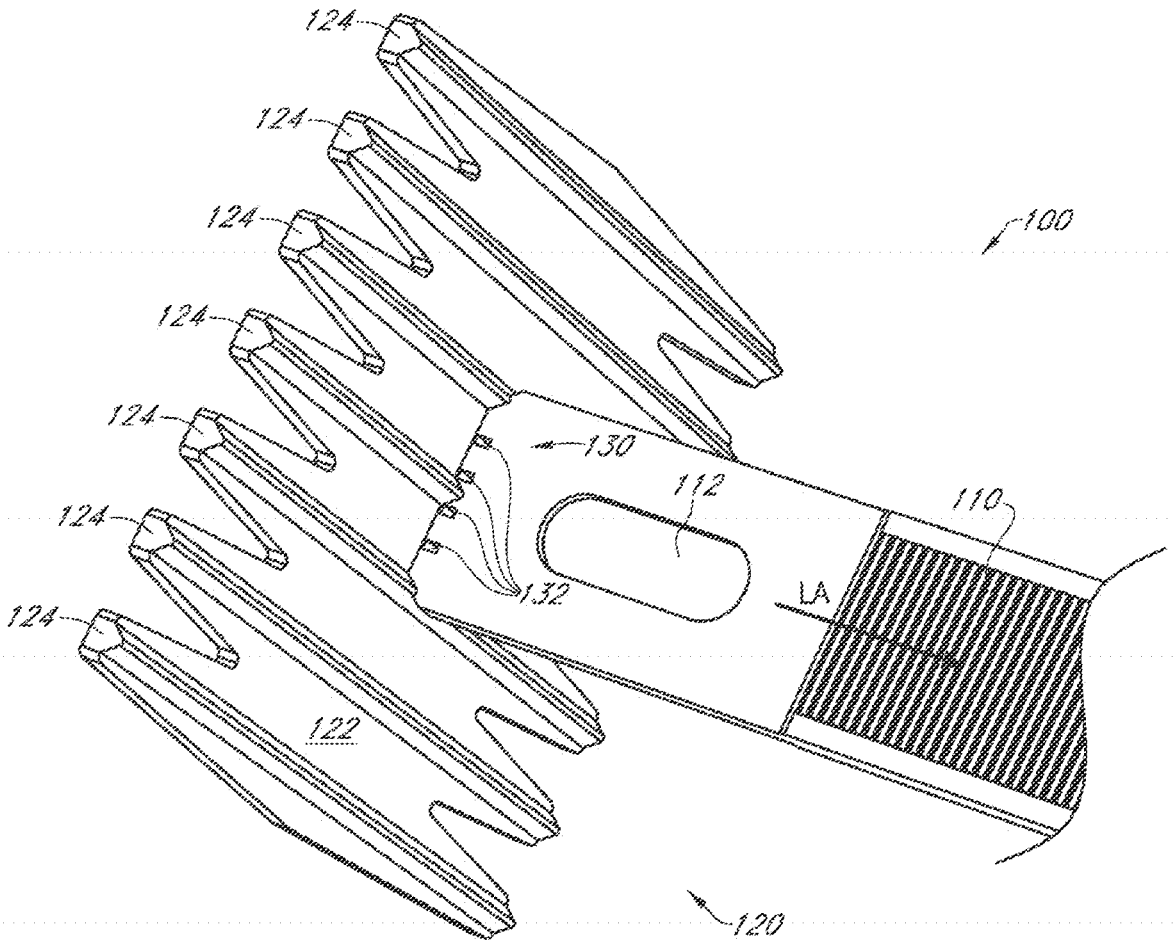
FIG. 1 is a perspective view of a strap and base/plate combination of the present invention.
Figure 2:
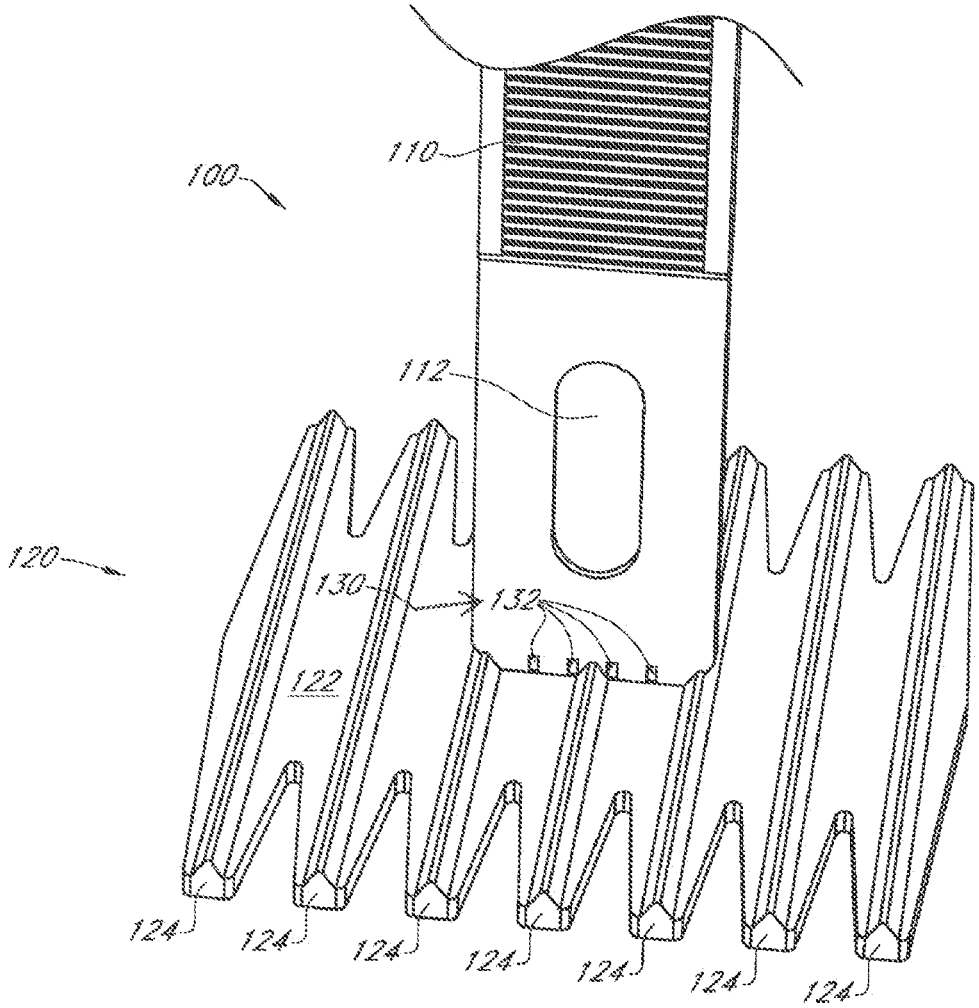
FIG. 2 shows an alternate perspective view of the strap of FIG. 1.
Figure 3:
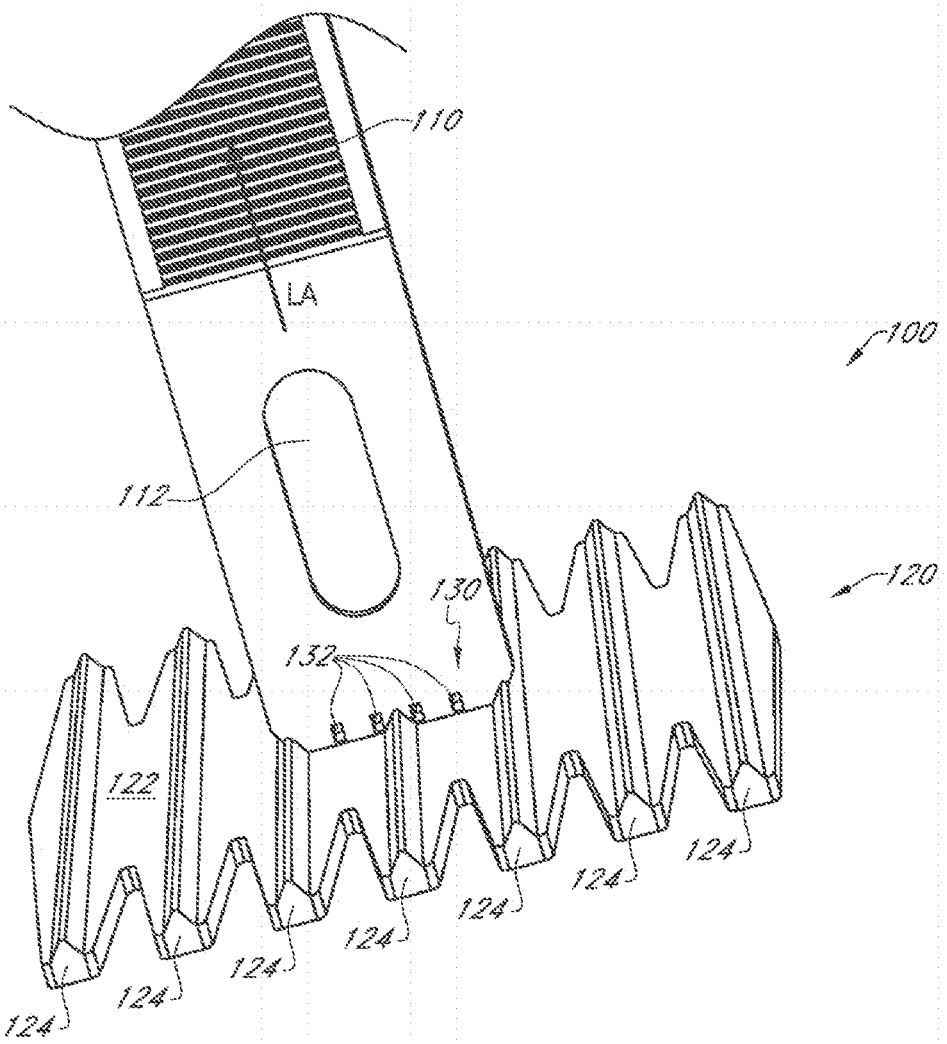
FIG. 3 shows an alternate view of the strap of FIGS. 1 and 2.

Now referring to FIGS. 1-3 where like numerals refer to like matter throughout. There is shown a one-piece plate strap combination 100 of the present invention which shows a strap 110, with a thin wall region 112 therein to allow for easier stretching of the strap 110 along its longitudinal axis LA. The strap 110 is formed with the bottom plate 120 which is formed a planar base 122 with a plurality of triangular cross section ridges 124 formed thereon where the apex of the triangular cross section is further along the longitudinal axis LA than the base plate portion 122. A plurality of voids 132 are located at the bottom thicker wall portion 130 of the strap 110, which voids are designed to allow easier separation of the strap 110 from the base plate 122. Voids 132 are ideally located adjacent to the base plate 122 and do not extend as far along the LA as do the tops of the ridges 124. The materials chosen for the combination 100 can be any suitable material where there is no significant compression or deflection of the ridges 124 when the system is deployed in normal and even abnormal conditions with excessive pressure being applied thereon. The material chosen would allow the strap to stretch on the LA and would allow the strap 110 to be separated from the base 122 through the voids 132 so that the separation point of the strap 110 and the bottom 120 is at a point along the LA closer to base plate 122 than the apex of the ridges 124 when they are fully loaded with pressure greater than the maximum needed for all reasonable uses of the combination 100.

Figure 4:
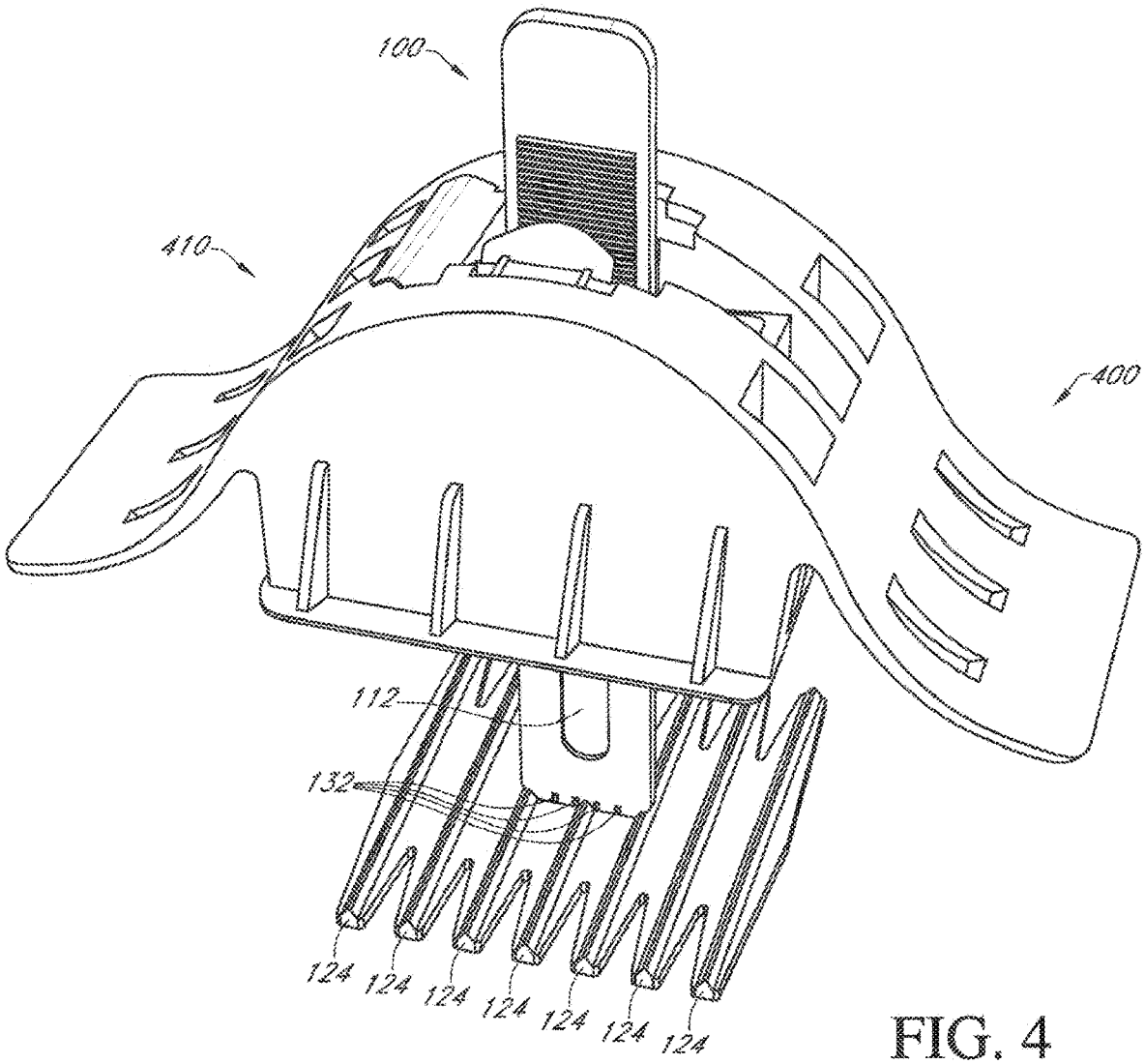
FIG. 4 shows a combination of the straps of FIGS. 1-3 and a flexible cap.

Now referring to FIG. 4, there is shown a system generally designated 400 which includes a cap 410 and the plate strap combination 100. Cap 410 is similar to the prior art cap shown in U.S. Pat. No. 8,429,878.

Figure 5:
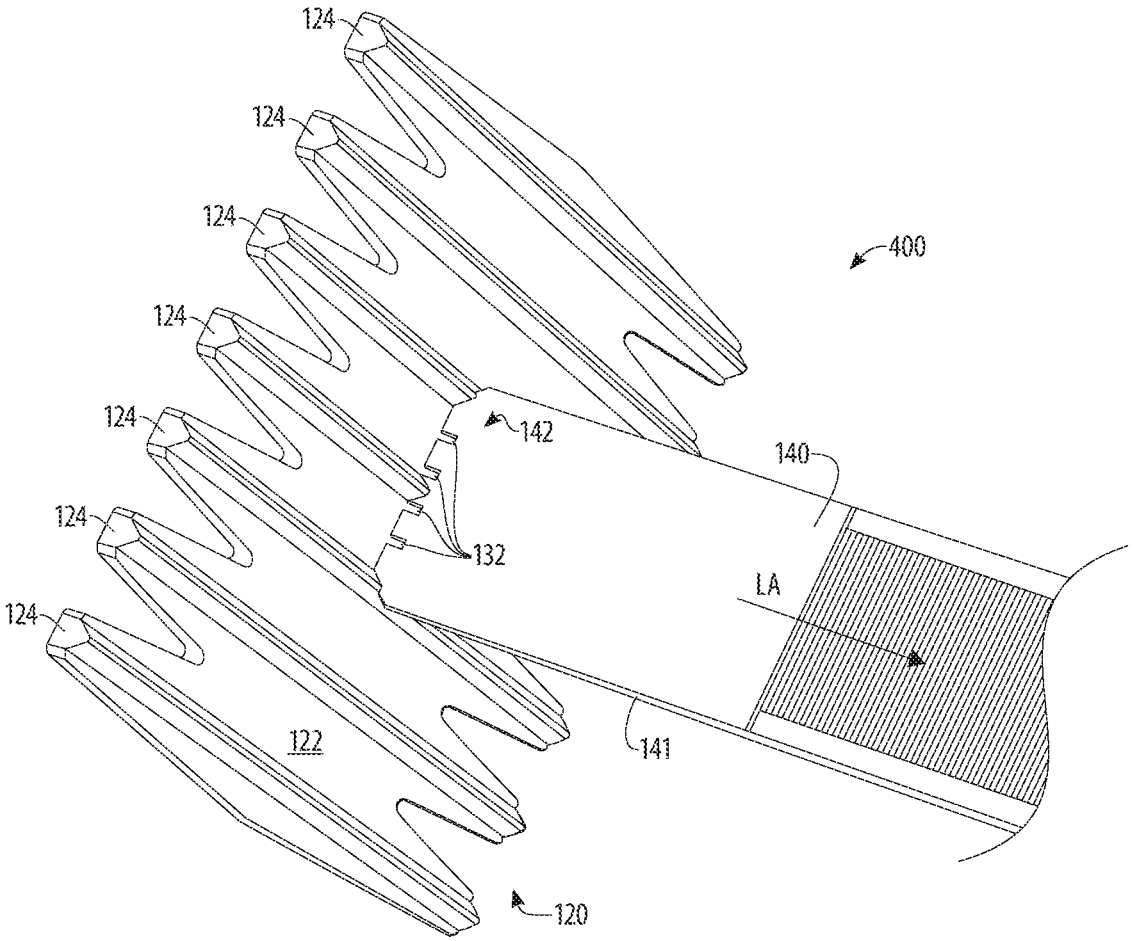
FIG. 5 is a perspective view of a tapering embodiment of a one-piece plate strap combination of the present invention.

Referring to FIG. 5, a tapering embodiment of the one-piece plate strap combination 400 provides a tapering strap 140 having a tapering thickness 141 becoming thinner approaching a bottom thinner wall portion 142 of the strap where the strap removably attaches to the base plate 122. The decreased thickness of the bottom thinner wall portion 142 of the tapering strap 140, removably attached to the base plate 122 and perforated by voids 132, provides sufficient strength to remain attached under the steady perpendicular force applied during normal use, while the mortar is setting, and also provide a site of easier separation using a sharp or oblique force after the mortar has set, or when the installed unit is accidentally kicked or struck during installation. Such easier and preferential separation at the bottom thinner wall portion 142 of the tapering strap 140 helps to avoid damage to the installed tiles by requiring less sharp or oblique force to be applied for removal, and helps ensure that only the base plate portion 122, and none of the tapering strap 140 remains embedded in the mortar, possibly requiring remediation by cutting or scraping in the gap between the installed tiles. Additionally, the taper of the tapering strap 140 along the whole portion below the tops of the tiles and between the tiles helps to avoid the tapering strap 140 becoming bound up and stuck by cured mortar, or becoming bound, pinched, or clamped between the tiles.

Throughout this description, the term lippage is used and is hereby defined as meaning relatively uneven edges existing with respect to adjacent tiles arranged in an array.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

We claim:

1. A method for reducing lippage in a plurality of tiles comprising the steps of:

(i) providing a substrate configured to be bondable to said plurality of tiles;

(ii) providing a base;

(iii) providing a first tile disposed adjacent said base;

(iv) providing a member extending from said base; where the member has a distance from the base as a longest dimension along a member longitudinal axis; a width of the member, which runs in a line parallel to a joint longitudinal axis of a joint containing said member, has a shorter dimension than said longest dimension, and is a dimension that is longer than a tapering thickness dimension of the member in a line which is orthogonal to the joint longitudinal axis; and where the member has a thin walled region surrounded by a thicker walled region and the thin-walled region is oval in shape;

(v) providing a cap;

(vi) causing said cap to engage and surround a portion of said member; and (vii) providing a pressure onto a surface of one of said plurality of tiles by compressing with pressure said cap, and thereby causing said member to stretch along said member longitudinal axis.

2. The method of claim 1, where said member further comprises a plurality of voids.

* * * * *